US010186242B2

(12) United States Patent
Ishioka et al.

(10) Patent No.: US 10,186,242 B2
(45) Date of Patent: Jan. 22, 2019

(54) MUSICAL PERFORMANCE DEVICE, MUSICAL PERFORMANCE METHOD, STORAGE MEDIUM AND ELECTRONIC MUSICAL INSTRUMENT

(71) Applicant: CASIO COMPUTER CO., LTD., Shibuya-ku, Tokyo (JP)

(72) Inventors: Yousuke Ishioka, Fussa (JP); Tomomi Notsu, Kodaira (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/692,933

(22) Filed: Aug. 31, 2017

(65) Prior Publication Data

US 2018/0068643 A1 Mar. 8, 2018

(30) Foreign Application Priority Data

Sep. 5, 2016 (JP) ..... 2016-172441

(51) Int. Cl.
*G10H 1/02* (2006.01)
*G10H 1/00* (2006.01)
(Continued)

(52) U.S. Cl.
CPC ..... *G10H 1/0025* (2013.01); *G10H 1/0033* (2013.01); *G10H 1/02* (2013.01);
(Continued)

(58) Field of Classification Search
CPC .... G10H 1/40; G10H 2240/325; G10H 1/361; G10H 1/20; G10H 2210/071; G10H 1/0033; G10H 2210/341
See application file for complete search history.

(56) References Cited

U.S. PATENT DOCUMENTS 7,432,436 B2 10/2008 Ito et al.
2004/0055444 A1* 3/2004 Ishii ..... G10H 1/0041 84/604
(Continued)

FOREIGN PATENT DOCUMENTS

JP 08202357 A 8/1996
JP 11259074 A 9/1999
(Continued)

OTHER PUBLICATIONS

Japanese Office Action dated Sep. 21, 2017 issued in counterpart Japanese Application No. 2016-172441.

*Primary Examiner* — Marlon Fletcher
(74) *Attorney, Agent, or Firm* — Holtz, Holtz & Volek PC

(57) ABSTRACT

A musical performance device is provided by which, even by a novice user's operation, an attack sound, which is musically important, can be emitted as intended. In the device, sequence data representing each note of a musical piece for musical performance is provided for each track. When the sequence data of a certain segment of at least one track among these tracks is being replayed, if a target track to be replayed is specified from among the tracks not being replayed, the sequence data of the certain segment of the target track is replayed at a speed higher than a normal speed in accordance with a calculated playback rate, and then the target track and the other track are replayed at the normal speed.

16 Claims, 10 Drawing Sheets

(51) Int. Cl.
*G10H 1/42* (2006.01)
*G10H 1/34* (2006.01)

(52) U.S. Cl.
CPC ..... *G10H 1/42* (2013.01); *G10H 1/344* (2013.01); *G10H 2210/061* (2013.01); *G10H 2210/076* (2013.01); *G10H 2210/385* (2013.01); *G10H 2240/325* (2013.01)

(56) References Cited

U.S. PATENT DOCUMENTS

2005/0081700 A1* 4/2005 Kikumoto ..... G10H 1/40 84/604
2005/0172787 A1* 8/2005 Tsurumi ..... G10H 1/0066 84/601
2005/0241465 A1* 11/2005 Goto ..... G10D 1/00 84/616
2008/0011149 A1* 1/2008 Eastwood ..... G10H 1/368 84/612
2008/0072744 A1 3/2008 Ito et al.
2009/0272253 A1* 11/2009 Yamashita ..... G10H 1/0025 84/611
2011/0011246 A1* 1/2011 Buskies ..... G10H 1/0066 84/613
2012/0118127 A1* 5/2012 Miyajima ..... G10H 1/0025 84/612
2012/0152088 A1* 6/2012 Ikeya ..... G10H 1/0016 84/612

FOREIGN PATENT DOCUMENTS

JP 2002169547 A 6/2002
JP 2008076779 A 4/2008
JP 5879996 B2 3/2016

* cited by examiner

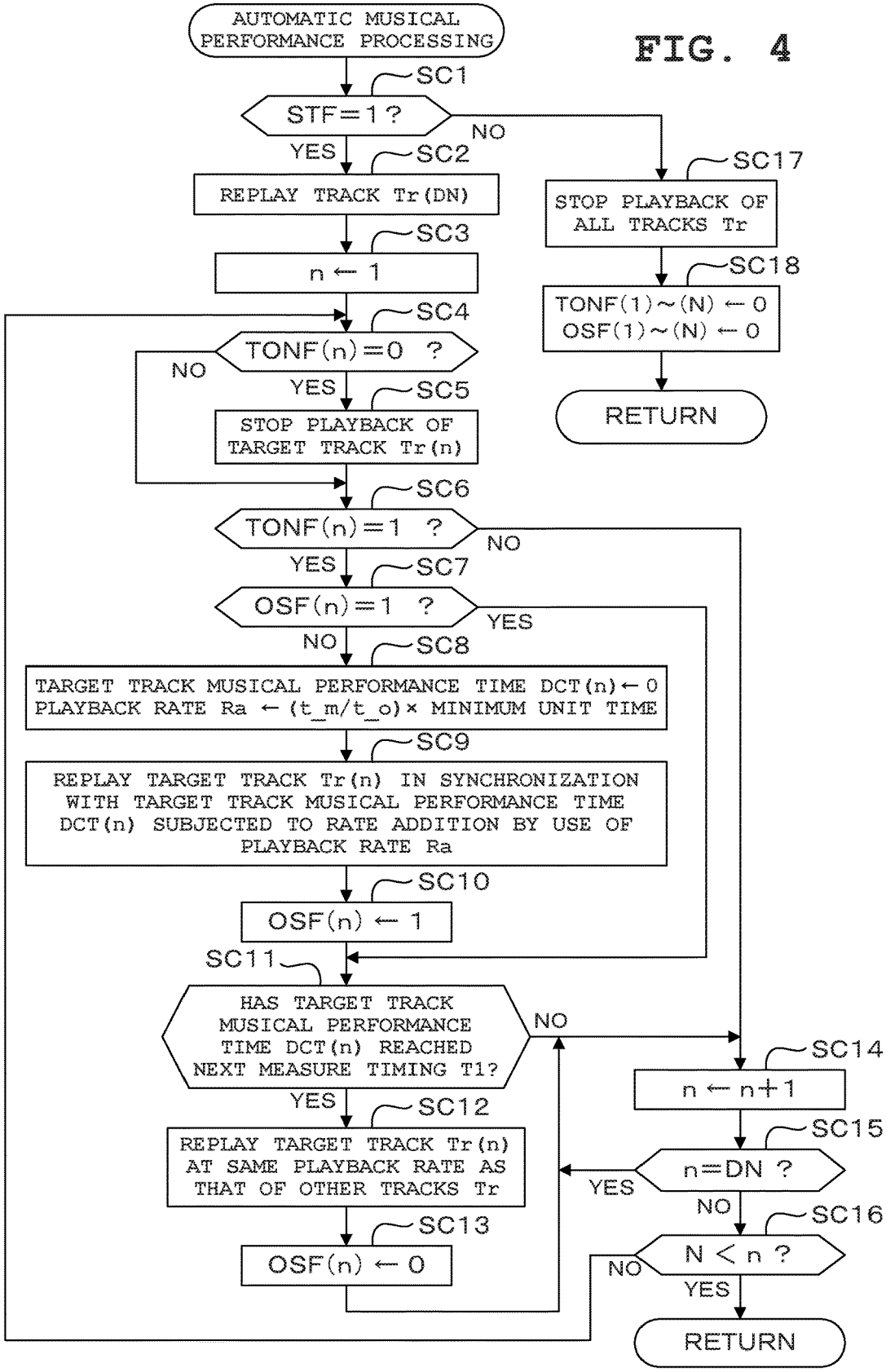
FIG. 4
AUTOMATIC MUSICAL PERFORMANCE PROCESSING
SC1
STF=1 ?
NO
YES
SC2
REPLAY TRACK Tr(DN)
SC3
n ← 1
SC4
TONF(n)=0 ?
NO
YES
SC5
STOP PLAYBACK OF TARGET TRACK Tr(n)
SC6
TONF(n)=1 ?
NO
YES
SC7
OSF(n)=1 ?
YES
NO
SC8
TARGET TRACK MUSICAL PERFORMANCE TIME DCT(n) ← 0
PLAYBACK RATE Ra ← (t_m/t_o)× MINIMUM UNIT TIME
SC9
REPLAY TARGET TRACK Tr(n) IN SYNCHRONIZATION WITH TARGET TRACK MUSICAL PERFORMANCE TIME DCT(n) SUBJECTED TO RATE ADDITION BY USE OF PLAYBACK RATE Ra
SC10
OSF(n) ← 1
SC11
HAS TARGET TRACK MUSICAL PERFORMANCE TIME DCT(n) REACHED NEXT MEASURE TIMING T1?
NO
YES
SC12
REPLAY TARGET TRACK Tr(n) AT SAME PLAYBACK RATE AS THAT OF OTHER TRACKS Tr
SC13
OSF(n) ← 0
SC14
n ← n+1
SC15
n=DN ?
YES
NO
SC16
N < n ?
NO
YES
RETURN
SC17
STOP PLAYBACK OF ALL TRACKS Tr
SC18
TONF(1)~(N) ← 0
OSF(1)~(N) ← 0
RETURN

PRIOR ART

MUSICAL PERFORMANCE DEVICE, MUSICAL PERFORMANCE METHOD, STORAGE MEDIUM AND ELECTRONIC MUSICAL INSTRUMENT

CROSS-REFERENCE TO RELATED APPLICATION

This application is based upon and claims the benefit of priority from the prior Japanese Patent Application No. 2016-172441, filed Sep. 5, 2016, the entire contents of which are incorporated herein by reference.

BACKGROUND OF THE INVENTION

1. Field of the Invention

The present invention relates to a musical performance device, a musical performance method, a storage medium and an electronic musical instrument by which an attack sound, which is musically important, can be emitted as intended even by a novice user's operation.

2. Description of the Related Art

An automatic musical performance device called a sequencer has been known. This device stores, in a memory, sequence data representing the pitch and sound emission timing of each note composing a musical piece for each of a plurality of tracks associated with musical performance parts (musical instrument parts), and sequentially reads out the sequence data for each track stored in the memory in synchronization with the tempo of the musical piece for playback (automatic musical performance). For example, in Japanese Patent Application Laid-Open (Kokai) Publication No. 2002-169547, this type of device has been disclosed, in which sequence data where a drum timbre and a non-drum timbre have been mixed in one track can be replayed.

In the field of dance music, there is a need for a musical performance method where the playback of a track of a desired musical performance part among a plurality of tracks during an automatic musical performance is turned ON/OFF in accordance with the "rhythm feeling" of the user's musical performance.

Specifically, it is desired that in an automatic musical performance device having a track ON/OFF function of stopping the playback of a target track specified by a user by a track-OFF operation and starting the playback of the sequence data of the target track at track-ON timing, a target track not being replayed is turned from OFF to ON and started to be replayed while a track other than the target track is being replayed.

However, in the above-described automatic musical performance device having the track ON/OFF function, when a target track (second music data) is subjected to a track-ON operation to start its playback while a track (first music data) other than the target track is being replayed, the following problem arises. This problem is described with reference to FIG. 10.

FIG. 10 is a diagram where the sequence data (here, in four-four time) of a plurality of tracks (1) to (n) associated with musical performance parts (musical instrument parts) are shown in time-series corresponding to a musical performance time TCT (horizontal axis) with the head of the musical piece as a starting point. Note that, among these tracks (1) to (n) tracks other than a target track (n) specified by a user are referred to as "other tracks".

When the target track (n) specified by the user is set to a track-OFF state and the playback of the sequence data of each track other than the target track (n) is started from the head of the musical piece as shown in FIG. 10, the sequence data of the first measure in each of the other tracks is replayed from the head. On the other hand, since the target track (n) is in the track-OFF state, the first measure of the target track (n) is not replayed.

Here, if the user wising to perform a track-ON operation for the target track (n) at the head of the second measure performs a track-ON operation at delayed timing later than timing where the first beat of the second measure can be replayed, the sequence data e(n) of the first beat of the second measure in the target track (n) is not replayed, and the playback of the target track (n) is started from the sequence data f(n) of the second beat. As a result, since the first beat of the target track (n), which is musically important, is not replayed, a musically uncomfortable feeling occurs, and thereby musical performance effects are impaired.

That is, it is particularly difficult for a novice user to perform a track-ON or track-OFF operation for a target track (second music data) as intended.

The present invention has been conceived in light of the above-described problem. An object of the present invention is to provide a musical performance device, a musical performance method, a storage medium, and an electronic musical instrument by which an attack sound, which is musically important, can be emitted as intended even by a novice user's operation.

SUMMARY OF THE INVENTION

In accordance with one aspect of the present invention, there is provided a musical performance device comprising an operator; and a processor, wherein the processor performs (i) first playback processing for playing back first music data, and (ii) second playback, processing for performing a fast-forward playback of a certain segment in second music data specified when the first music data is being played back by the first playback processing, in accordance with a playback rate acquired based on timing at which the second music data has been specified, wherein the fast-forward playback is performed at a playback speed faster than a playback speed of the first music data in the first playback processing.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The present invention can be more clearly understood by the detailed description below being considered together with the following drawings.

FIG. 4 is a flowchart of operations to be performed by the CPU 13 in automatic musical performance processing according to the first embodiment;

DETAILED DESCRIPTION OF THE PREFERRED EMBODIMENTS

Embodiments of the present invention will hereinafter be described with reference to the drawings.

A. Structure

Figure 1:
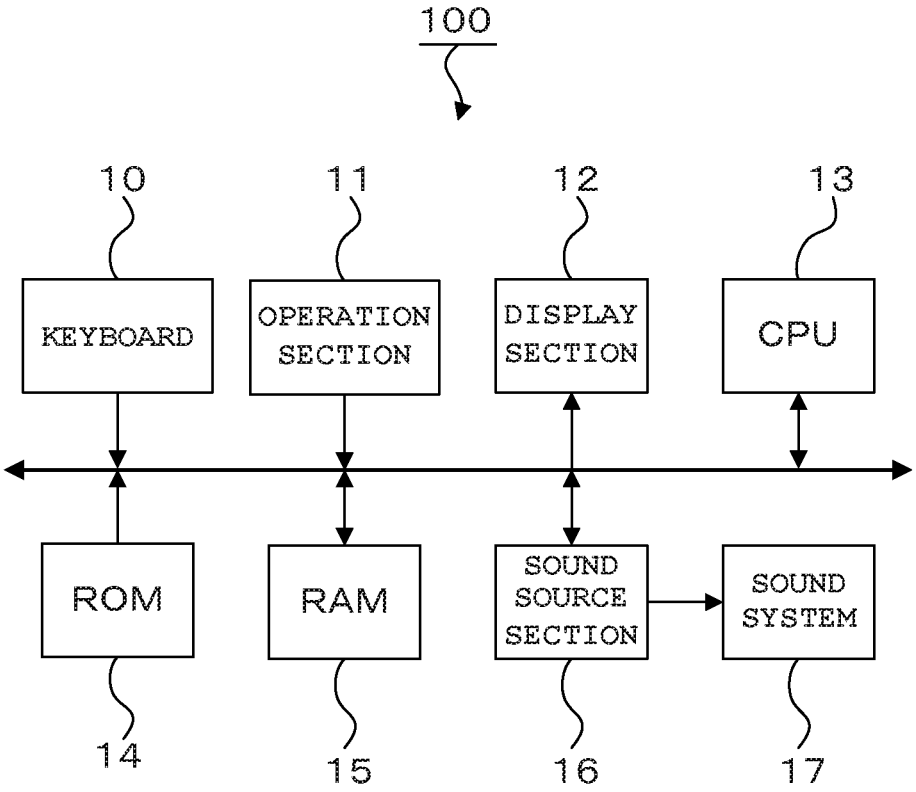
FIG. 1 is a block diagram showing an electric structure of an electronic musical instrument 100 according to a first embodiment of the present invention.

FIG. 1 is a block diagram showing the entire structure of an electronic musical instrument 100 according to a first embodiment of the present invention. A keyboard 10 in FIG. 1 generates musical performance input information including a key-ON/key-OFF signal, a key number, a velocity, and the like in accordance with a musical performance input operation (key press/release operation). The musical performance input information generated by the keyboard 10 is converted by a CPU 13 into a note-ON/note-OFF event in MIDI format and then supplied to a sound source section 16. Also, in the keyboard 10, key switches of a plurality of keys in a predetermined key area function as track ON/OFF switches (1) to (N) included in an operation section 11 described below.

The operation section 11 is constituted by a power supply switch for turning a device power supply ON/OFF, a music selection switch for selecting a musical piece for an automatic musical performance, a start/stop switch for providing an instruction to start or stop an automatic musical performance, key switches of a plurality of keys assigned to a plurality of tracks corresponding to respective musical performance parts (musical instrument parts) for automatic musical performances, and the like, and includes various operation switches such as the above-described track ON/OFF switches (1) to (N) for providing an instruction to turn a relevant track ON (start playback) or OFF (stop playback) a For example, four white keys included in the keyboard musical instrument are assigned with pattern phrases of different tracks such as a drum part, a bass guitar part, a synthesizer 1 part, and a synthesizer 2 part. Note that the number of tracks to be assigned herein is not limited to four and may be three, five, or any number. This operation section 11 generates switch events of types corresponding to switch operations, and these various switch events generated by the operation section 11 are loaded into the CPU 13.

The above-described start/stop switch and track ON/OFF switches (1) to (N) function as so-called toggle switches whose ON/OFF state alternately changes for each depression operation. That is, the depression operations herein include an ON operation for giving a start instruction to enter an ON state and an OFF operation for giving a stop instruction to enter an OFF state. A display section 12 in FIG. 1 is constituted by a color liquid-crystal display panel, a display driver, and the like, and displays on its screen the setting status, operation status, and the like of each section of the musical instrument in accordance with a display control signal supplied from the CPU 13.

The CPU 13 sets the operation status of each section of the device based on various switch events supplied from the operation section 11, instructs the sound source section 16 to generate musical sound waveform data W based on musical performance input information supplied from the keyboard 10, or instructs the sound source section 16 to start or stop an automatic musical performance in accordance with a depression operation on the start/stop switch.

This CPU 13 also controls a playback mode for a target track based on the timing of an ON operation on a track ON/OFF switch during an automatic musical performance, arid instructs the sound source section 16 to replay a musical performance part (musical instrument part) corresponding to the target track in accordance with the controlled playback mode. On the other hand, in response to an OFF operation on the track ON/OFF switch, the CPU 13 instructs the sound source section 16 to stop the playback of the musical performance part (musical instrument part) corresponding to the target track. These characteristic processing operations of the CPU 13 according to the gist of the present invention, that is, the operations in the automatic musical performance processing will be described later in detail.

Figure 2A:
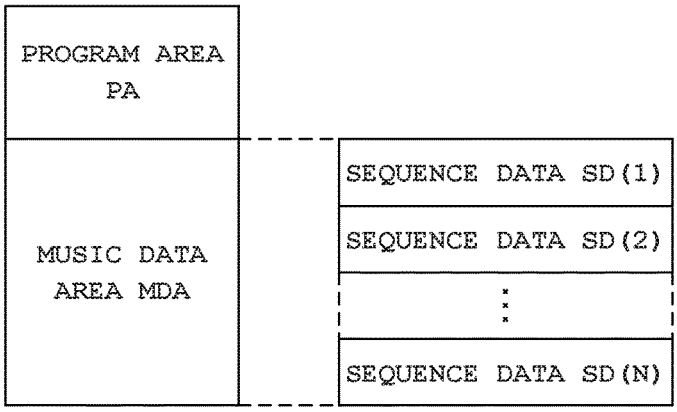
FIG. 2A is a memory map showing a data structure in an ROM (Read Only Memory) 14.

A ROM 14 in FIG. 1 includes a program area PA and a music data area MDA, as shown in FIG. 2A. In the program area PA of the ROM 14, various control programs to be loaded into the CPU 13 are stored. The various control programs herein include a program for a main routine described below and programs for switch processing and the automatic musical performance processing to be called from the main routine. In the music data area MDA of the ROM 14, sequence data SD(1) to SD(N) of a plurality of musical pieces are stored, and one of these sequence data SD(1) to SD(N) of the plurality of musical pieces is selected as music data in response to an operation on the above-described music selection switch.

Figure 2B:
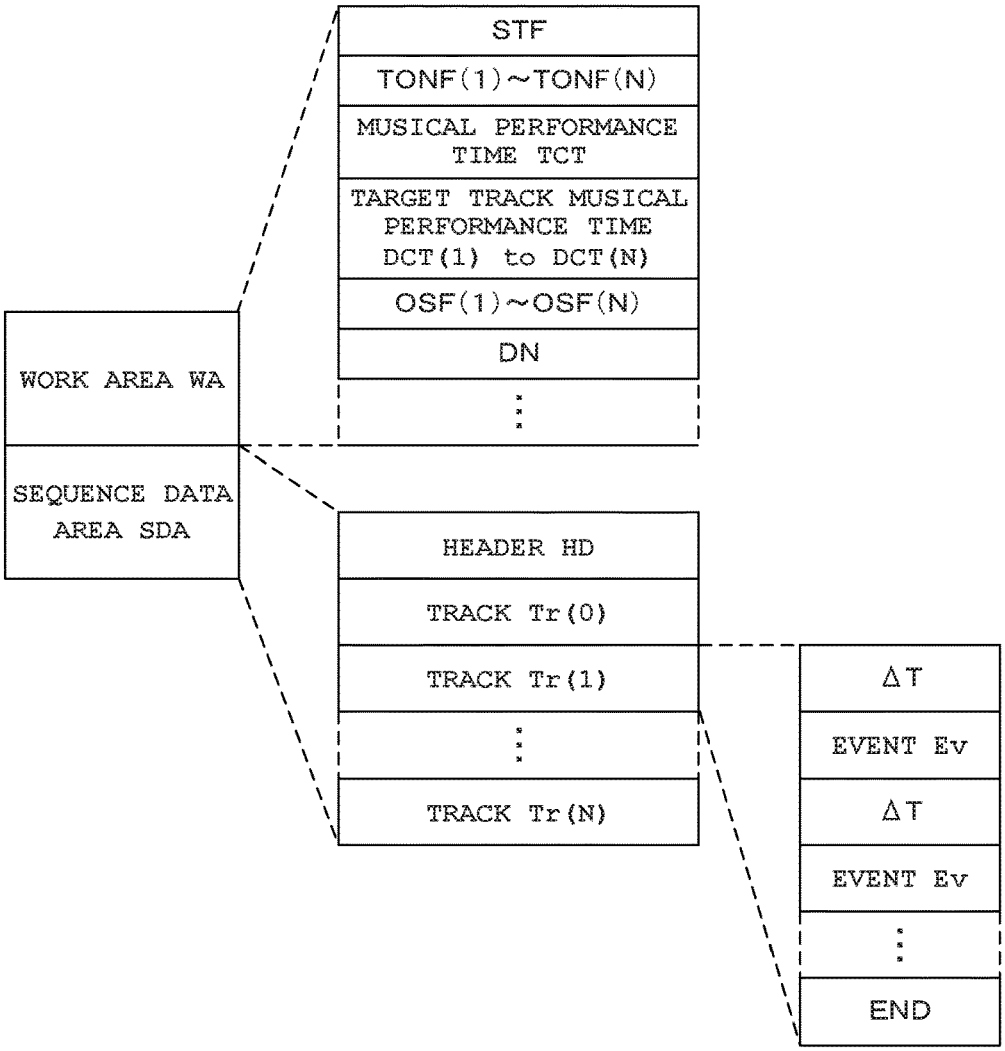
FIG. 2B is a memory map showing the structure of main register/flag data and sequence data stored in a RAM (Random Access Memory) 15.

A RAM 15 in FIG. 1 includes a sequence data area SDA and a work area WA, as shown in FIG. 2B. In the sequence data area SDA of the RAM 15, the sequence data SD(n) of a musical piece selected by a music selection switch operation and read out from the music data area MDA of the ROM 14 is stored.

The sequence data SD(n) is constituted by a header HD, a track Tr(0), and tracks Tr(1) to Tr(N). In the header HD, a format indicating a data format, a time base indicating a resolution, and the like are stored. In the track Tr(0), the title, tempo (BPM), meter of the musical piece, and the like are stored. In the tracks Tr(1) to Tr(N) corresponding to musical performance parts (musical instrument parts), sequence data SD indicating the pitch and sound emission timing of each note forming a corresponding musical performance part is stored.

In the sequence data SD, a delta time $\Delta T$ indicating the timing of a current event Ev based on a differential time from the previous event and an event Ev indicating a pitch to be emitted or muted have been combined as one set, and a plurality of such sets have been addressed in time-series corresponding to the musical progress. The end of the sequence data SD is provided with END data indicating the end of the musical piece.

In the work area WA of the RAM 15, various pieces of register/flag data for use in processing by the CPU 13 are temporarily stored. FIG. 2B shows main register/flag data according to the gist of the present invention. A start/stop flag STF in FIG. 2 is a flag to be reversed in response to a depression operation on the above-described start/stop switch, of which "1" indicates that an automatic musical performance is started (or is being given) and "0" indicates that an automatic musical performance has been stopped.

Track ON/OFF flags TONF(1) to TONF(N) in FIG. 2B are flags to be reversed in response to a depression operation on the above-described track ON/OFF switches (1) to (N), that is, the key switches assigned to the tracks Tr(1) to Tr(N) corresponding to the respective musical performance parts (musical instrument parts) for automatic musical performances, of which "1" indicates that the playback of a corresponding musical part (musical instrument part) is started (or is being performed) and "0" indicates that the playback of a corresponding musical part (musical instrument part) has been stopped.

A musical performance time TCT in FIG. 2B is a timer counter which counts time elapsed from when the start/stop flag STF is set to "1", that is, time elapsed from the head of the musical piece. This musical performance time TCT is counted by tick accumulation by known timer interruption processing not shown. Target track musical performance times DCT(1) to DCT(N) in FIG. 2B are timer counters which counts the musical performance times of the tracks Tr(1) tri Tr(N) associated with the musical performance parts (musical instrument parts), respectively.

Flags OSF(1) to OSF(N) in FIG. 2B are flags which are "1" during a playback at a playback rate Ra described below and are "0" in other cases, in each of the tracks Tr(1) to Tr(N) corresponding to the respective musical performance parts (musical instrument parts) for automatic musical performances. The default track number "DN" represents the track number of a track to be uniquely replayed (or replayed hut muted not to emit sound) when there is no track Tr set to be replayed by the above-described track ON/OFF switch at the time of the start of an automatic musical performance.

Note that, in the below descriptions regarding operations, tracks which include at least a track Tr(DN) specified by the default track number DN and are replayed in synchronization with the musical performance time TCT are each referred to as "another track (first music data)". Also, a "target track (second music data)" which is compared with this "another track" indicates a track Tr(n) associated with a track ON/OFF switch (n) subjected to an ON operation, and is replayed in synchronization with a target track musical performance time DCT(n).

In the configuration of the present embodiment, a single track is specified by the default track number DN for simplification of description. However, the present invention is not limited thereto, and a configuration may be adopted in which a plurality of default track numbers DN1, DN2, . . . , and DNn are provided to specify a plurality of tracks. Moreover, as a default setting method, a method of arbitrarily setting by a user or a factory-preset method may be adopted.

Referring back to FIG. 1, the structure of the electronic musical instrument 100 is further described. The sound source section 16 in FIG. 1, which includes a plurality of sound emission channels formed based on a known waveform memory reading method, generates musical sound data in response to a note-ON/OFF event based on musical performance input information, or replays the sequence data SD of each track Tr(1) to Tr(N) read out from the sequence data area SDA of the RAM 15 by the CPU 13 in accordance with the progress of an automatic musical performance so as to generate musical performance sound data for each track. A sound system 17 in FIG. 1 converts musical sound data/musical performance sound data outputted from the sound source section 16 into musical sound signals/musical performance sound signals in an analog format performs filtering such as removing unnecessary noise from the musical sound signals/musical performance sound signals, and then amplifies the resultant signals to emit sounds from a loudspeaker (not shown).

B. Operations

Next, as operations of the above-structured electronic musical instrument 100, each operation in the main routine to be performed by the CPU 13 and each operation in the switch processing and the automatic musical performance processing to be called from the main routine are described with reference to FIG. 3A to FIG. 6.

(1) Operations in Main Routine

Figure 3A:
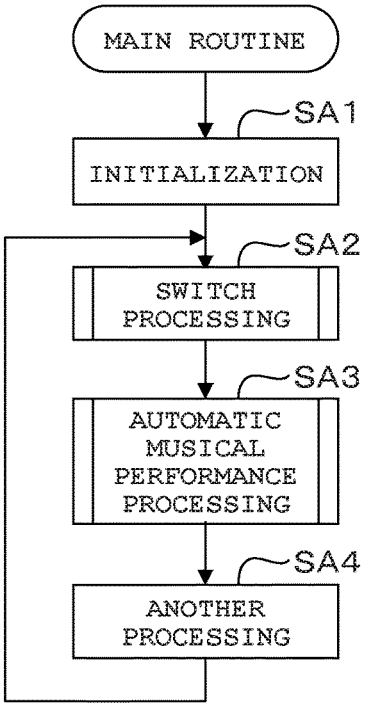
FIG. 3A is a flowchart of operations to be performed by a CPU (Central Processing Unit) 13 in a main routine.

FIG. 3A is a flowchart of operations to be performed by the CPU 13 in the main routine. When the main routine is started in response to a power-on operation on the electronic musical instrument 100, the CPU 13 first proceeds to Step SA1 shown in FIG. 3A, and performs initialization processing for initializing various registers/flags in the RAM 15. Then, the CPU 13 proceeds to Step SA2 to perform the switch processing.

As will be described later, in the switch processing, the CPU 13 reads out from the ROM 14 the sequence data SD of a musical piece selected in accordance with the user's music selection switch operation, and transfers the read sequence data SD to the sequence data area SDA. Also, the CPU 13 reverses the start/stop flag STF in accordance with the user's depression operation on the start/stop switch. Moreover, in accordance with the user's depression operation on a track ON/OFF switch (n), the CPU 13 reverses a ON/OFF flag TONF(n) associated with this track ON/OFF switch (n).

Next, the CPU 13 proceeds to Step SA3 to perform the automatic musical performance processing. In the automatic musical performance processing, when the start/stop flag STF is set at "1" in accordance with the user's start/stop switch operation, the CPU 13 replays a track Tr(DN) specified by the default track number DN among a plurality of tracks Tr(1) to Tr(N) associated with musical performance parts (musical instrument parts), in synchronization with a musical performance time TCT. In addition, the CPU 13 detects, for each track ON/OFF switch (1) to (N) associated with the tracks Tr(1) to Tr(N), whether or not an ON operation or an OFF operation has been performed.

When there is a track ON/OFF switch (n) subjected to an OFF operation, the CPU 13 stops the playback of a target track Tr(n) associated with this switch. Also, when there is a track ON/OFF switch (n) subjected to an ON operation, the CPU 13 resets a target track musical performance time DCT(n) for a target track Tr(n) associated with this switch to zero and replays this target track Tr(n) to next measure timing T1 by fast-forwarding in synchronization with the target track musical performance time DCT(n) subjected to rate addition in accordance with a playback rate Ra based on a ratio between one measure length t_m and the next measure timing T1—the musical performance time TCT at the time of the ON operation on the track ON/OFF switch (n).

When the target track musical performance time DCT(n) reaches the next measure timing T1, the CPU 13 replays the target track Tr(n) in synchronization with the musical performance time TCT. As a result of this configuration, it is possible to avoid conventional drawbacks that track-ON timing is shifted, a musically uncomfortable feeling occurs, and musical performance effects are impaired. In addition, even by a novice user's operation, the musical performance effects can be achieved as intended without giving musically uncomfortable feelings.

Then, the CPU 13 proceeds to Step SA4. Here, the CPU 13 performs, for example, processing of converting musical performance input information generated in response to a key press/release operation on the keyboard 10 into a note-ON/OFF event in MIDI format, and supplying the event to the sound source section 16 so as to instruct the sound source section 16 to emit a sound or mute, and another processing of providing a user-specified effect to the generated musical sound. Then, the CPU 13 returns to Step SA2 described above. Thereafter, until the electronic musical instrument 100 is turned off, the CPU 13 repeats Step SA2 to Step SA4 described above.

(2) Operations in Switch Processing

Figure 3B:
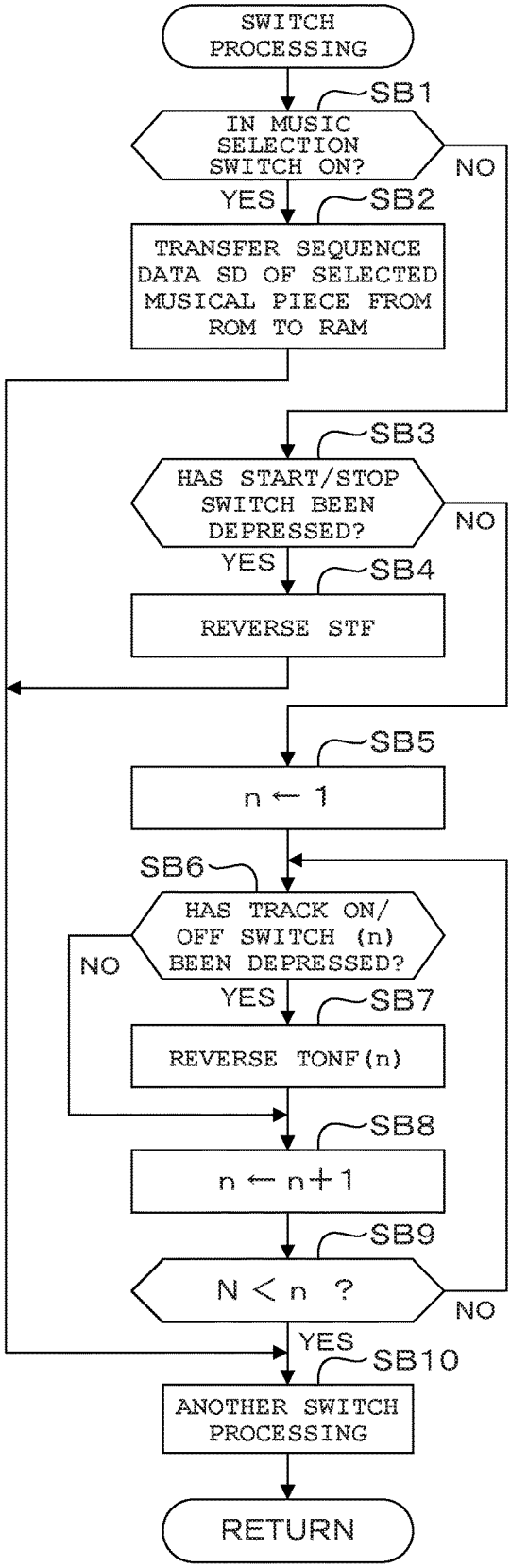
FIG. 3B is a flowchart of operations to be performed by the CPU 13 in switch processing.

FIG. 3B is a flowchart of operations to be performed by the CPU 13 in the switch processing. When the switch processing is started via Step SA2 of the above-described main routine (refer to FIG. 3A), the CPU 13 proceeds to Step SB1 shown in FIG. 3B and judges whether an ON operation has been performed on the music selection switch. When an ON operation has been performed on the music selection switch by the user, since the judgment result at Step SB1 is "YES", the CPU 13 proceeds to Step SB2, reads out the sequence data SD of a musical piece selected by the operation on the music selection switch from the music data area MDA (refer to FIG. 2) of the ROM 14, and transfers the sequence data SD to the sequence data area SDA of the RAM 15. Then, the CPU 13 proceeds to Step SB10 described later.

Conversely, when no operation has been performed on the music selection switch, since the judgment result at Step SB1 is "NO", the CPU 13 proceeds to Step SB3, and judges whether a depression operation has been performed on the start/stop switch. When a depression operation has been performed on the start/stop switch by the user, since the judgment result at Step SB3 is "YES", the CPU 13 proceeds to Step SB4 and reverses the start/stop flag STF. Then, the CPU 13 proceeds to Step SB10 described later.

Conversely, when no operation has been performed on the start/stop switch, since the judgment result at Step SB3 is "NO", the CPU 13 proceeds to Step SB5 and sets a pointer "n" at an initial value of "1" o Subsequently, the CPU 13 proceeds to Step SB6 and judges whether a depression operation has been performed on a track ON/OFF switch (n) specified by the pointer n. When no depression operation has been performed, since the judgment result is "NO", the CPU 13 proceeds to Step SB8, increments the pointer n, and then proceeds to Step SB9. At Step SB9, the CPU 13 judges whether the incremented pointer n has exceeded the number of tracks N. When the incremented pointer n has not exceeded the number of the tracks N, the judgment result is "NO" and therefore the CPU 13 returns to Step SB6.

At Step SB6, when a depression operation has been performed on a track ON/OFF switch (n) specified by the incremented pointer n, since the judgment result is "YES", the CPU 13 proceeds to Step SB7 and reverses a track ON/OFF flag TONF(n) specified by the incremented pointer n. Subsequently, the CPU 13 proceeds to Step SB8 and increments the pointer n. Then, at Step SB9, the CPU 13 judges whether the incremented pointer n has exceeded the number of the tracks N.

Thereafter, until all the track ON/OFF switches (n) are judged as to whether a depression operation has been performed, the CPU 13 repeats Step SB6 to Step SB9 described above. As a result, all ON/OFF flags TONF(n) associated with track ON/OFF switches (n) subjected to depression operations are reversed. When the CPU 13 ends the judgments as to whether a depression operation has been performed for all the track ON/OFF switches (n), the judgment result at Step SB9 is "YES" and therefore the CPU 13 proceeds to Step SB10. At Step SB10, the CPU 13 performs another switch processing, such as processing of selecting the timbre of a musical sound to be generated in accordance with a timbre selection switch operation or selecting an effect for the musical sound to be generated in accordance with an effect selection switch, and then ends the processing.

As described above, in the switch processing, the CPU 13 reads out from the ROM 14 the sequence data SD of a musical piece selected in accordance with the user's music selection switch operation, and transfers the sequence data SD to the sequence data area SDA of the RAM 15. Also, the CPU 13 reverses the start/stop flag STF in accordance with the user's depression operation on the start/stop switch. Moreover, in accordance with the user's depression operation on a track ON/OFF switch (n), the CPU 13 reverses a ON/OFF flag TONF(n) associated with the track ON/OFF switch (n).

(3) Operations in Automatic Musical Performance Processing

FIG. 4 is a flowchart of operations to be performed by the CPU 13 in the automatic musical performance processing. When this processing is started via Step SA3 of the above-described main routine (refer to FIG. 3A), the CPU 13 proceeds to Step SC1 shown in FIG. 4, and judges whether the start/stop flag STF indicates "1", that is, whether the electronic musical instrument 100 is in a state where an automatic musical performance is started (or is being given). In the following descriptions regarding the operations of this processing, operations "in a case where an automatic musical performance is started (or is being given) and operations "in a case where an automatic musical performance is stopped" are described separately.

<In Case where Automatic Musical Performance is Started (or Automatic Musical Performance is being Given)>

When the start/stop flag STF is set at "1" in accordance with the user's start/stop switch operation, the judgment result at Step SC1 described above is "YES" and therefore the CPU 13 proceeds to Step SC2. At Step SC2, the CPU 13 replays the track Tr(DN) specified by the default track number DN among the plurality of tracks Tr(1) to Tr(N) associated with the musical performance parts (musical instrument parts). Specifically, the CPU 13 reads out the sequence data SD of the track Tr(DN) and supplies the sequence data SD to the sound source section 16. Then, the sound source section 16 emits a musical sound (automatic musical performance sound) based on the sequence data SD supplied from the CPU 13.

When the track Tr(DN) specified by the default track number DN is replayed, the CPU 13 proceeds to the next Step SC3 and sets the pointer n for specifying a track at an initial value of "1". Subsequently, the CPU 13 proceeds to Step SC4 and judges whether a track ON/OFF flag TONF(n) specified by the pointer n indicates "0", that is, whether the playback of a track Tr(n) specified by the pointer n has been set to be stopped by the user's track ON/OFF switch operation.

When the track ON/OFF flag TONF(n) indicates "0" (the playback has been set to be stopped), since the judgment result at Step SC4 described above is "YES", the CPU 13 proceeds to Step SC5, stops the playback of the target track Tr(n), and proceeds to Step SC6. Note that the target track herein refers to a track of a musical performance part (musical instrument part) associated with a track ON/OFF switch (key switch) subjected to a depression operation.

On the other hand, when the track ON/OFF flag TONF(n) specified by the pointer n indicates "1", the judgment result at Step SC4 is "NO" and therefore the CPU 13 proceeds to Step SC6. At Step SC6, the CPU 13 judges whether the track ON/OFF flag TONF(n) specified by the pointer n indicates "1", that is, whether the playback of the target track Tr(n) has been set to be started by the user's track ON/OFF switch operation.

When the track ON/OFF flag TONF(n) indicates "0", that is, when the playback of the target track Tr(n) has been set to be stopped by the user's track ON/OFF switch operation, the judgment result is "NO" and therefore the CPU 13 proceeds to Step SC14 described later.

On the other hand, when the track ON/OFF flag TONF(n) indicates "1", that is, the playback of the target track Tr(n) has been set to be started by the user's track ON/OFF switch operation, since the judgment result at Step SC6 is "YES", the CPU 13 proceeds to Step SC7, and judges whether a flag OSF(n) specified by the pointer n indicates "1", that is, whether the target track Tr(n) set to be replayed by the track ON/OFF switch operation is being replayed in accordance with a playback rate Ra described later.

When the target track Tr(n) set to be replayed by the track ON/OFF switch operation is not being replayed in accordance with the playback rate Ra, the judgment result is "NO" and therefore the CPU 13 proceeds to Step SC8. At Step SC8, the CPU 13 resets a target track musical performance time DCT(n) specified by the pointer n to zero and calculates a playback rate Ra in accordance with the following equation (1)

$$\text{Playback rate Ra}=(t_m/t_o)\times\text{minimum unit time} \quad (1)$$

In the above equation (1), for example, "t_m" is one measure length. This one measure length is calculated by 60/BPM (tempo)×the number of beats. This BPM (tempo) and the number of beats are extracted from a track Tr(0). "t/o" is a timing length from ON timing of a track ON/OFF switch (timing of an ON operation) to the next measure timing T1, and is calculated by subtracting a musical performance time TCT at the time of the ON operation on the track ON/OFF switch from the next measure timing T1. This next measure timing T1 is extracted from the sequence data SD of a target track Tr(n), "minimum unit time" is one tick calculated by 60/BPM (tempo)/time base (resolution).

Next, the CPU 13 proceeds to Step SC9 and replays the target track Tr(n) in synchronization with the target track musical performance time DCT(n) subjected to rate addition by using the playback rate Ra calculated at Step SC8 based on the above-described equation (1). That is, when an ON operation is performed on the track ON/OFF switch (n) of the target track Tr(n) while another track Tr(DN) is being replayed in synchronization with the musical performance time TCT, the CPU 13 replays the sequence data SD of the target track Tr(n) by fast-forwarding from the head of the musical piece in accordance with the playback rate Ra, from the ON timing to the next measure timing T1.

When the target track Tr(n) is started to be replayed by fast-forwarding from the head of the musical piece in accordance with the playback rate Ra in response to the ON operation on the track ON/OFF switch (n), the CPU 13 proceeds to Step SC10. At Step SC10, the CPU 13 sets the flag OSF(n) specified by the pointer n at "1" so as to indicated that the playback is being performed in accordance with the playback rate Ra, and then proceeds to Step SC11.

Note that, when automatic musical performance processing is again performed while the target track Tr(n) is being replayed by fast-forwarding from the head of the musical piece in accordance with the playback rate Ra with the flag OSF(n) specified by the pointer n being set at "1", the CPU 13 makes a judgment of "YES" at Step SC7 described above, and proceeds to Step SC11.

At Step SC11, the CPU 13 judges whether the target track musical performance time DCT(n) of the target track Tr(n) being replayed by fast-forwarding from the head of the musical piece in accordance with the playback rate Ra has reached the next measure timing T1. If the target track musical performance time DCT(n) has not reached the next measure timing T1, the judgment result is "NO" and therefore the CPU 13 proceeds to Step SC14 described later.

Conversely, when the target track musical performance time DCT(n) has reached the next measure timing T1, since the judgment result at Step SC11 is "YES", the CPU 13 proceeds to Step SC12 and replays the target track Tr(n) specified by the pointer n in synchronization with the musical performance time TCT at the same playback rate as that of other tracks Tr including the track Tr(DN) specified by the default track number DN and currently being replayed. Then, the CPU 13 proceeds to Step SC13, resets the flag OSF(n) specified by the pointer n to zero, and proceeds to Step SC14.

At Step SC14, the CPU 13 increments the pointer n. At the subsequent Step SC15, the CPU 13 judges whether the value of the incremented pointer n matches the default track number DN. When the value of the incremented pointer n matches the default track number DN, the judgment result is "YES" and therefore the CPU 13 again proceeds to Step SC14 to increment the pointer n.

That is, when the start/stop flag STF indicates "1", the track Tr(DN) specified by the default track number DN is uniquely replayed (or replayed but muted not to emit sound) in synchronization with the musical performance time TCT regardless of the presence of a track ON/OFF switch operation as described above, and therefore is excluded from the above-described series of processing.

On the other hand, when the value of the incremented pointer n does not match the default track number DN, since the judgment result at Step SC15 described above is "NO", the CPU 13 proceeds to Step SC16 and judges whether the incremented pointer n has exceeded the track number "N", that is, whether the processing has been completed for all the tracks Tr(1) to Tr(N) corresponding to the musical performance parts (musical instrument parts).

When the processing has not been completed for all the tracks Tr(1) to Tr(N), the judgment result is "NO" and therefore the CPU 13 repeats the processing at Step SC4 and the following steps. When the processing has been completed for all the tracks Tr(1) to Tr(N), since the judgment result at Step SC16 is "YES", the CPU 13 once completes the automatic musical performance processing and returns to the main routine.

<In Case where Automatic Musical Performance is Stopped>

When the start/stop flag STF is set at "0" in accordance with the user's start/stop switch operation, the judgment result at Step SC1 described above is "NO" and therefore the CPU 13 proceeds to Step SC17. At Step SC17, the CPU 13 instructs the sound source section 16 to stop playback operations for all the tracks Tr(1) to Tr(N) corresponding to the musical performance parts (musical instrument parts). Subsequently, the CPU 13 proceeds to Step SC18 and resets the track ON/OFF flags TONF(1) to TONF(N) and the flags OSF(1) to OSF(N) to zero. Then, the CPU 13 completes the processing and returns to the main routine.

Figure 5:
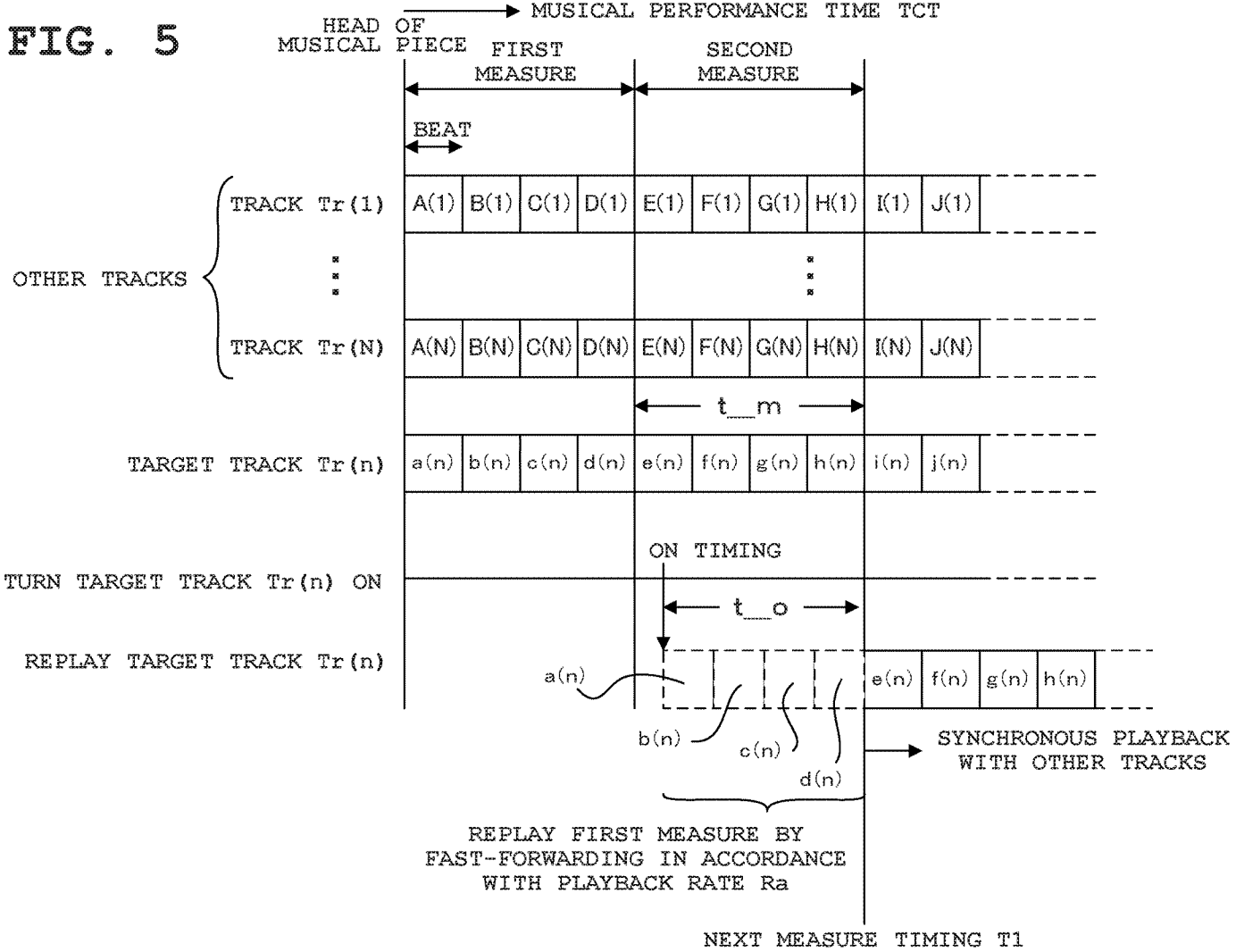
FIG. 5 is a diagram for describing a specific example of the operations in the automatic musical performance processing according to the first embodiment.

As described above, in the automatic musical performance processing, when the start/stop flag STF is set at "1" in accordance with the user's start/stop switch operation, the CPU 13 replays, among the plurality of tracks Tr(1) to Tr(N) corresponding to the musical performance parts (musical instrument parts), the sequence data SD of tracks Tr(1) to Tr(N) other than a target track Tr(n) from the head of the musical piece in synchronization with the musical performance time TCT, as shown in FIG. 5.

Here, for example, when the user performs an ON operation on a track ON/OFF switch (n) associated with the target track Tr(n) to replay the target track Tr(n) from the head of the second measure, the following operations are performed if the actual ON timing is slightly later than the head of the second measure as shown in FIG. 5.

First, the CPU 13 resets the target track musical performance time DCT(n) to zero, and replays the sequence data SD of the first measure of the target track Tr(n) to the next measure timing T1 in synchronization with the target track musical performance time DCT(n) subjected to rate addition by use of a playback rate Ra calculated based on the above-described equation (1).

That is, from the timing of the ON operation on the track ON/OFF switch (n) to the next measure timing T1, the CPU 13 replays the sequence data SD (corresponding to notes a(n) to d(n) in the first measure) of the target track Tr(n) by fast-forwarding in accordance with the playback rate Ra.

Then, when the target track musical performance time DCT(n) reaches the next measure timing T1, the CPU 13 replays the target track Tr(n) at the same playback rate as that of the other tracks Tr(1) to Tr(N) which are being replayed in synchronization with the musical performance time TCT. As a result of this configuration, it is possible to avoid conventional drawbacks that track-ON timing is shifted, a musically uncomfortable feeling occurs, and musical performance effects are impaired. In addition, even by a novice user's operation, the musical performance effects can be achieved as intended without giving musically uncomfortable feelings.

C. Second Embodiment

Next, a second embodiment is described. The structure of the second embodiment is the same as that of the above-described first embodiment, and therefore is not described herein. In the following descriptions, the data structure of the RAM 15 of the second embodiment and the automatic musical performance processing of the second embodiment, which are different from those of the first embodiment, are described.

(1) Data Structure of RAM 15

Figure 6:
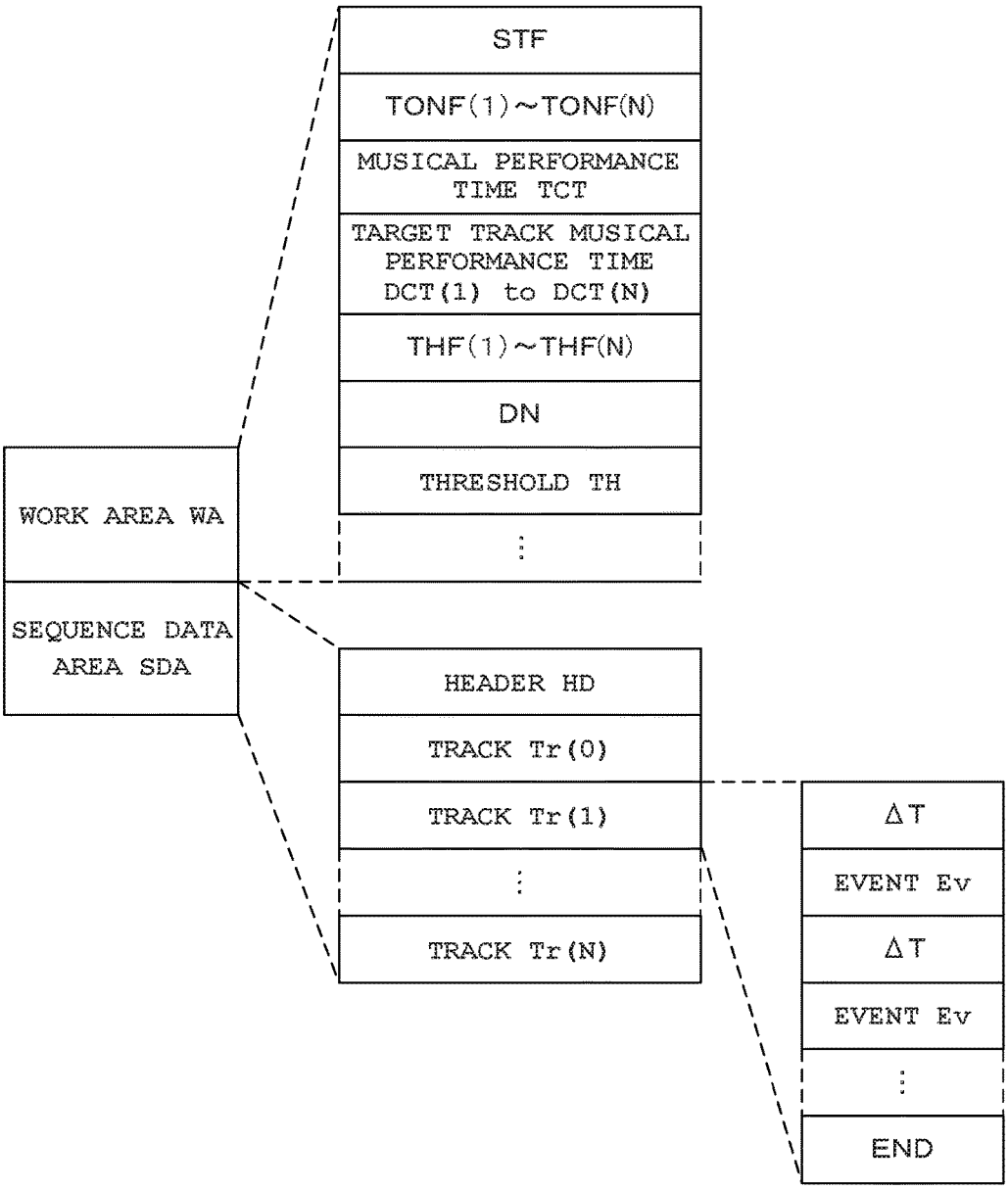
FIG. 6 is a memory map showing the structure of main register/flag data and sequence data stored in the RAM 15 of an electronic musical instrument 100 according to a second embodiment.

FIG. 6 is a memory map showing the structure of main register/flag data and sequence data stored in the RAM 15 of the electronic musical instrument 100 according to the second embodiment. The memory map shown in FIG. 6 is different from that of the first embodiment shown in FIG. 2B in that it includes flags THF(1) to THF(N) and a threshold TH.

The flags THF(1) to THF(N) indicate "1" when the sequence data SD of a target track Tr(n) started to be replayed by a track ON/OFF switch operation has been fast-forwarded with mute ON to the head of a measure currently being replayed in another track Tr from the head of a musical piece and is currently being replayed with mute OFF in accordance with a playback rate Ra described later, and indicates "0" in other cases. The purpose of these flags will be described later.

The threshold TH represents the time length of a predetermined period from the head of a measure. As will be described later, in the second embodiment, when an ON operation is performed on a track ON/OFF switch (n) within the threshold TH from the head of a measure, the timing of the ON operation (ON timing) is regarded to coincide with the head of the measure.

Figure 7:
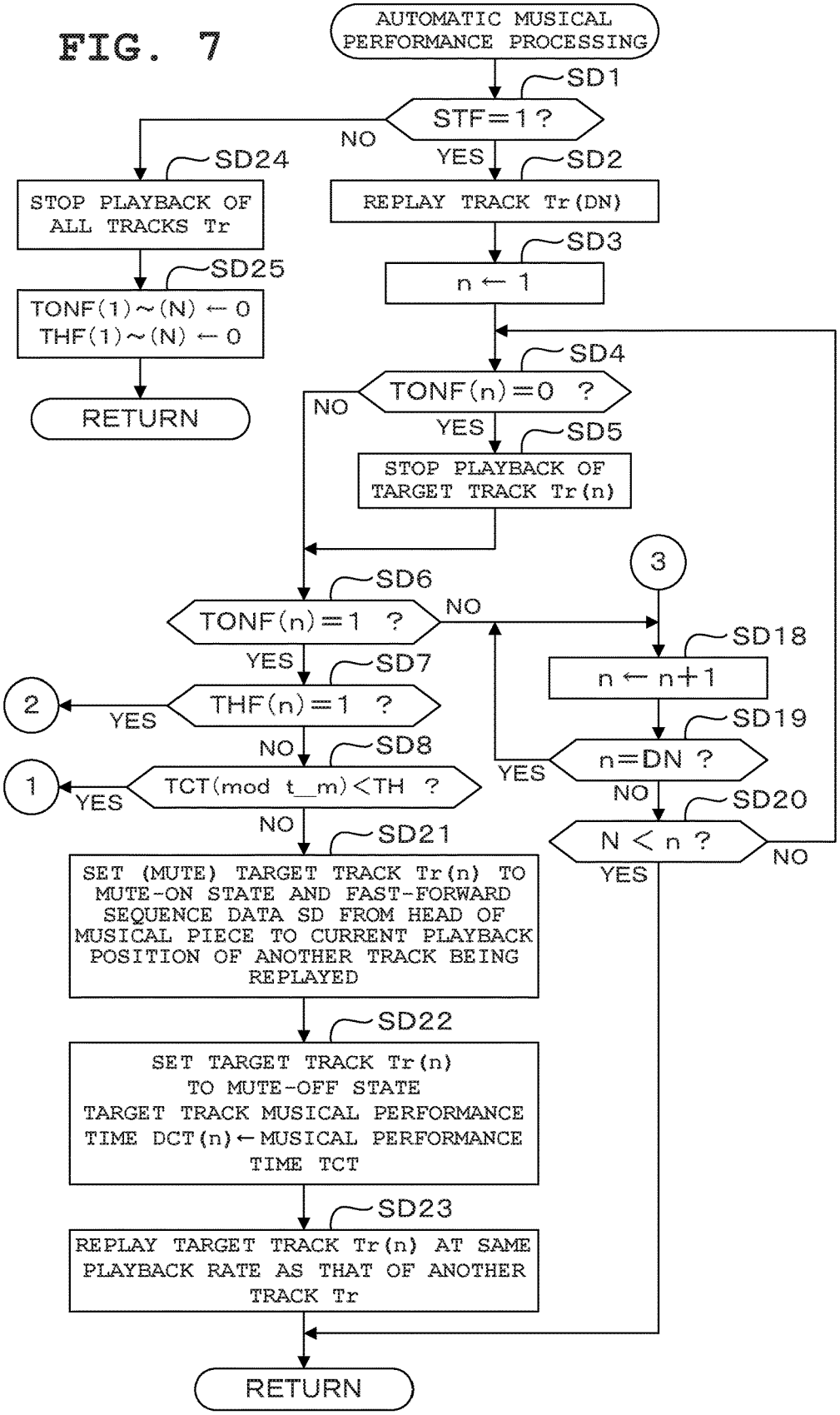
FIG. 7 is a flowchart of operations to be performed by the CPU 13 in automatic musical performance processing according to the second embodiment.
Figure 8:
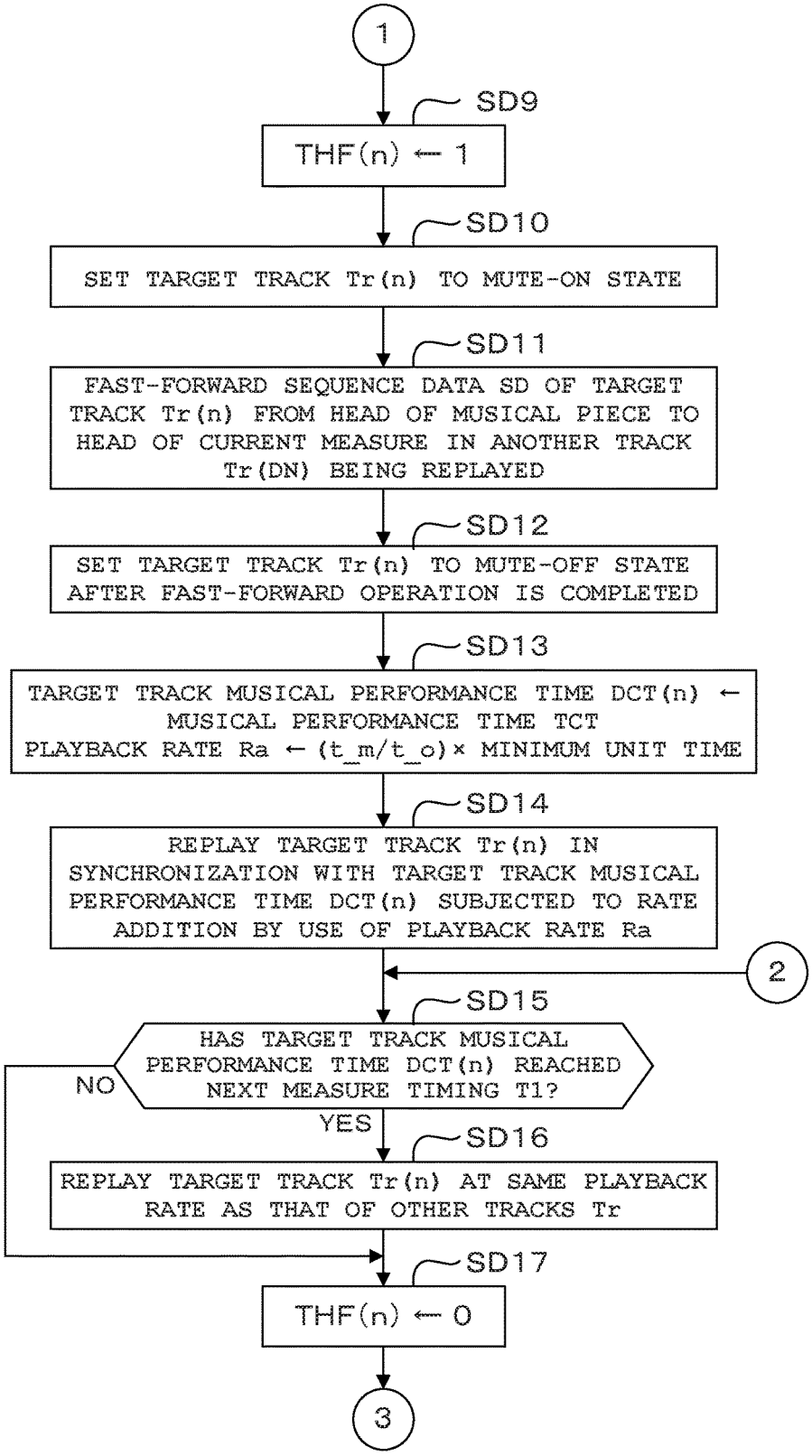
FIG. 8 is also a flowchart of the operations to be performed by the CPU 13 in the automatic musical performance processing according to the second embodiment.

(2) Operations in Automatic Musical Performance Processing According to Second Embodiment Next, operations in the second embodiment are described with reference to FIG. 7 and FIG. 8. FIG. 7 and FIG. 8 are flowcharts of operations to be performed by the CPU 13 in automatic musical performance processing. As with the above-described first embodiment, when the automatic musical performance processing according to the second embodiment is started to be performed via Step SA3 (refer to FIG. 3A) of the main routine, the CPU 13 proceeds to Step SD1 shown in FIG. 8, and judges whether the start/stop flag STF indicates "1", that is, whether the electronic musical instrument 100 is in a state where an automatic musical performance is started (or is being given). In the following descriptions regarding the operations of this processing, operations "in a case where an automatic musical performance is started (or is being given) and operations "in a case where an automatic musical performance is stopped" are described separately.

<In Case where Automatic Musical Performance is Started (or Automatic Musical Performance is being Given)>

When the start/stop flag STF is set at "1" in accordance with the user's start/stop switch operation, the judgment result at Step SD1 is "YES" and therefore the CPU 13 proceeds to Step SD2. At Step SD2, the CPU 13 replays a track Tr(DN) specified by the default track number DN among a plurality of tracks Tr(1) to Tr(N) associated with musical performance parts (musical instrument parts). Specifically, the CPU 13 reads out the sequence data SD of the track Tr(DN) and supplies the sequence data SD to the sound source section 16. Then, the sound source section 16 emits a musical sound based on the sequence data SD supplied from the CPU 13.

When the track Tr(DN) specified by the default track number DN is replayed, the CPU 13 proceeds to the next Step SD3 and sets the pointer n for specifying a track at an initial value of "1". Subsequently, the CPU 13 proceeds to Step SD4 and judges whether a track ON/OFF flag TONF(n) specified by the pointer n indicates "0", that is, whether the playback of a track Tr(n) specified by the pointer n has been set to be stopped by the user's track, ON/OFF switch operation.

When the track ON/OFF flag TONF(n) indicates "0" (stop the playback), since the judgment result at Step SD4 is "YES", the CPU 13 proceeds to Step SD5, stops the playback of the target track Tr(n), and then proceeds to Step SD6. Note that the target track herein refers to a track of a musical performance part (musical instrument part) associated with a track ON/OFF switch (key switch) subjected to a depression operation.

On the other hand, when the track ON/OFF flag TONF(n) specified by the pointer n indicates "1", the judgment result at Step SD4 is "NO" and therefore the CPU 13 proceeds to Step SD6. At Step SD6, the CPU 13 judges whether the track ON/OFF flag TONF(n) specified by the pointer n indicates "1", that is, whether the playback of the target track Tr(n) has been set to be started by the user's track ON/OFF switch operation.

When the track ON/OFF flag TONF(n) indicates "0", that is, the playback of the target Tr(n) has been set to be stopped by the user's track ON/OFF switch operation, the judgment result is "NO" and therefore the CPU 13 proceeds to Step SD18 described later.

On the other hand, when the track ON/OFF flag TONF(n) indicates "1", that is, the playback of the target track Tr(n) has been set to be started by the user's track ON/OFF switch operation, the judgment result at Step SD6 is "YES" and therefore the CPU 13 proceeds to Step SD7. At Step SD7, the CPU 13 judges whether a flag THF(n) specified by the pointer n indicates "1", that is, whether the sequence data SD of the target track Tr(n) started to be replayed by the track ON/OFF switch operation has been fast-forwarded with mute ON to the head of a measure currently being replayed in another track Tr(DN) from the head of the musical piece and is currently being replayed with mute OFF in accordance with a playback rate Ra.

When the target track Tr(n) has been fast-forwarded with mute ON and is currently being replayed with mute OFF in accordance with the playback rate Ha (the flag THF(n) indicates "1"), the judgment result of Step SD7 is "YES" and therefore the CPU 13 proceeds to Step 5015 described later (refer to FIG. 8).

Conversely, if this is not the case where the target track (n) has been fast-forwarded with mute-ON and is currently being replayed with mute-OFF in accordance with the playback rate Ra (the flag THF(n) indicates "0"), the judgment result at Step SD7 is NO and therefore the CPU 13 proceeds to Step SD8.

At Step SD8, the CPU 13 judges whether TCT (mod t_m)<the threshold TH, that is, whether the ON timing of the track ON/OFF switch (n) specified by the pointer n is within the threshold TH from the head of the measure currently being replayed in synchronization with the musical performance time TCT. "TCT (mod t_m)" herein represents a modulo operation on the musical performance time TCT by one measure length t_m.

In the following descriptions of operations, operations in a case where the ON timing of the track ON/OFF switch (n) is within the threshold TH from the head of the measure currently being replayed in synchronization with the musical performance time TCT and operations in a case where the ON timing has exceeded the threshold TH are separately described.

a. In Case where on Timing is within Threshold TH from Head of Current Measure in this case, since the judgment result at Step SD8 described above "YES", the CPU 13 proceeds to Step SD9 shown in FIG. 8, and sets the flag THF(n) specified by the pointer n at "1". Subsequently, the CPU 13 proceeds to Step SD10, and sets the target track Tr(n) specified by the pointer n to a mute-ON state (muted state). Subsequently, the CPU 13 proceeds to Step SD11, and fast-forwards the sequence data SD of the target track Tr(n) in the mute-ON state (muted state) from the head of the musical piece to the head of the measure currently being replayed in another track Tr(DN).

Then, the CPU 13 proceeds to Step SD12, and sets the fast-forwarded target track Tr(n) to a mute-OFF state (sound emission state). Next, at Step SD13, the CPU 13 sets the musical performance time TCT at a target track musical performance time DCT(n) specified by the pointer n and calculates a playback rate Ra in accordance with the following equation (2).

$$\text{Playback rate Ra}=(t_m/t_o)\times\text{minimum unit time} \quad (2)$$

In the above equation (2), for example, "t_m" is one measure length, and is calculated by 60/BPM (tempo)×the number of beats. This BPM (tempo) and the number of beats are extracted from a track Tr(0) "t/o" is a timing length from ON timing of a track ON/OFF switch (timing of an ON operation) to the next measure timing T1, and is calculated by subtracting a musical performance time TCT at the time of the ON operation on the track ON/OFF switch from the next measure timing T1. This next measure timing T1 is extracted from the sequence data SD of a target track Tr(n), "minimum unit time" is one tick calculated by 60/RPM (tempo)/time base (resolution).

When the playback rate Ra is calculated as described above, the CPU 13 proceeds to Step SD14 and replays the target track Tr(n) by fast-forwarding in synchronization with the target track musical performance time DCT(n) subjected to rate addition by use of the calculated playback rate Ra. Next, the CPU 13 proceeds to Step SD15 and judges whether the target track musical performance time DCT(n) of the target track Tr(n) currently being replayed by fast-forwarding in accordance with the playback rate Ra has reached the next measure timing T1.

When the target track musical performance time DCT(n) has not reached the next measure timing T1, the judgment result is "NO" and therefore the CPU 13 proceeds to Step SD17 described later. Conversely, when the target track musical performance time DCT(n) has reached the next measure timing T1, since the judgment result at Step SD15 is "YES", the CPU 13 proceeds to the next Step SD16 and replays the target track Tr(n) specified by the pointer n at the same playback rate as that of other tracks Tr including the track Tr(DN) specified by the default track number DN which is being replayed in synchronization with the musical performance time TCT.

Then, the CPU 13 proceeds to Step SD17, resets the flag THF(n) specified by the pointer n to zero, and proceeds to Step SD18 shown in FIG. 7. At Step SD18, the CPU 13 increments the pointer n. Subsequently, at Step SD19, the CPU 13 judges whether the value of the incremented pointer n matches the default track number DN.

When the value of the incremented pointer n matches the default track number DN, since the judgment result is "YES", the CPU 13 again proceeds to Step SD18 and increments the pointer n. That is, when the start/stop flag STF indicates "1", the track Tr(DN) specified by the default track number DN is uniquely replayed (or replayed but muted not to emit sound) in synchronization with the musical performance time TCT regardless of the presence of a track ON/OFF switch operation as described above, and therefore is excluded from the above-described series of processing.

On the other hand, when the value of the incremented pointer n does not match the default track number DN, since the judgment result at Step SD19 described above is "NO", the CPU 13 proceeds to Step SD20 and judges whether the incremented pointer n has exceeded the track number "N", that is, whether the processing has been completed for all the tracks Tr(1) to Tr(N) corresponding to the musical performance parts (musical instrument parts).

When the processing has not been completed for all the tracks Tr(1) to Tr(N), the judgment result is "NO" and therefore the CPU 13 repeats the processing at Step SD4 and the following steps. When the processing has been completed for all the tracks Tr(1) to Tr(N), since the judgment result at Step SD20 is "YES", the CPU 13 once completes the automatic musical performance processing and returns to the main routine.

b. In Case where ON Timing has Exceeded Threshold TH

In this case, since the judgment result at Step SD8 described above is "NO", the CPU 13 proceeds to Step SD21 shown in FIG. 7, sets the target track Tr(n) specified by the pointer n to a mute-ON state (muted state) and fast-forwards the sequence data SD of the target track Tr(n) from the head of the musical piece to the current playback position of another track Tr(DN).

Subsequently, at Step SD22, the CPU 13 sets the target track Tr(n) specified by the pointer n to a mute-OFF state (sound emission state), and sets the musical performance time TCT at the target track musical performance time DCT(n) specified by the pointer n. Subsequently, the CPU 13 proceeds to Step SD23 and replays the target track Tr(n) specified by the pointer n at the same playback rate as that of another track Tr(DN). Then, the CPU 13 completes the processing and returns to the main routine.

<In Case where Automatic Musical Performance is Stopped>

When the start/stop flag STF is set at "0" in accordance with the user's start/stop switch operation, the judgment result at Step SD1 described above is "NO" and therefore the CPU 13 proceeds to Step SD24. At Step SD24, the CPU 13 instructs the sound source section 16 to stop playback operations for all the tracks Tr(1) to Tr(N) corresponding to the musical performance parts (musical instrument parts). Subsequently, the CPU 13 proceeds to Step SD25 and resets the track ON/OFF flags TONF(1) to TONE(N) and the flags THF(1) to THF(N) to zero. Then, the CPU 13 once completes the processing and returns to the main routine.

Figure 9:
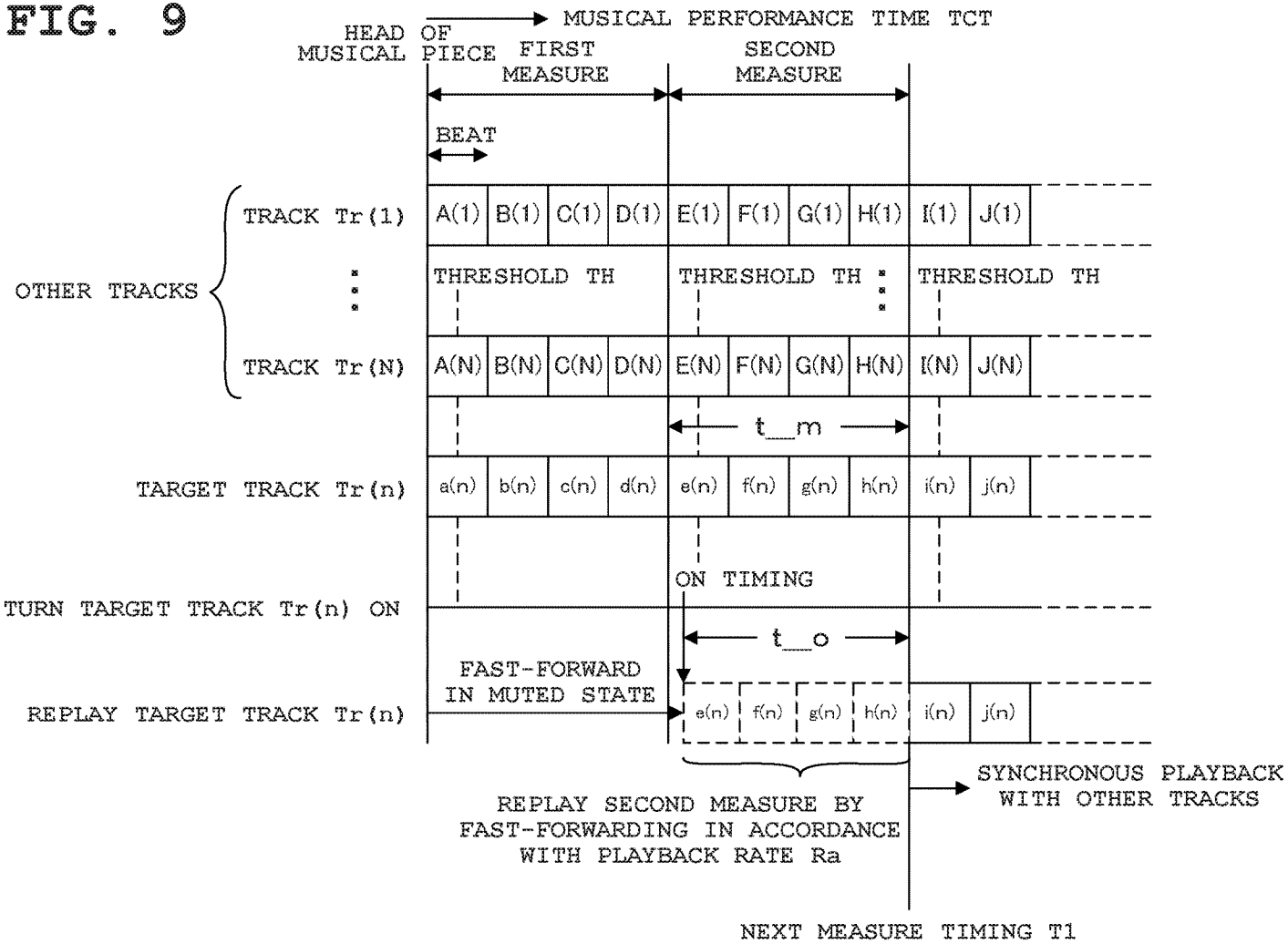
FIG. 9 is a diagram for describing a specific example of the operations in the automatic musical performance processing according to the second embodiment.
Figure 10:
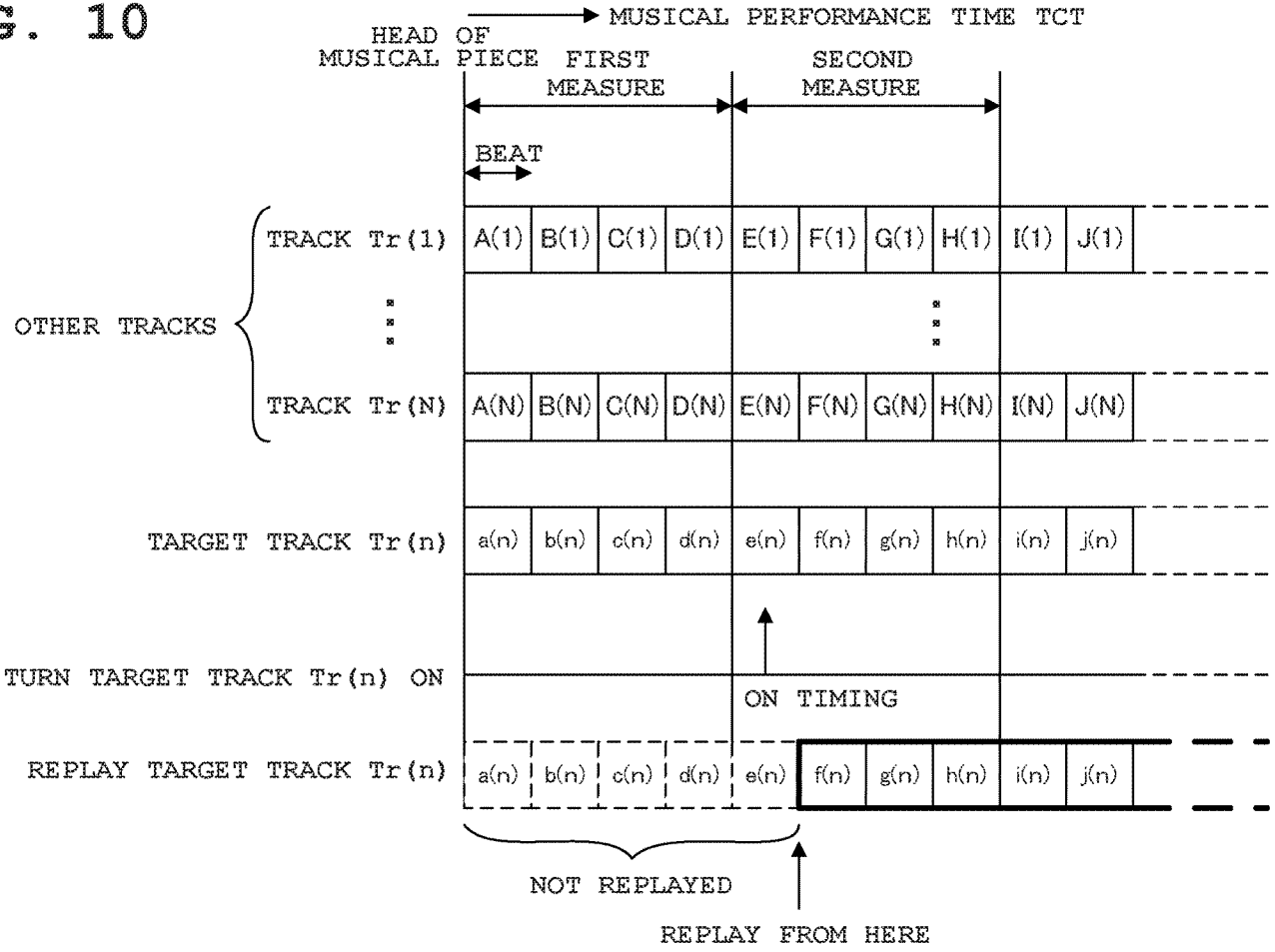
FIG. 10 is a diagram for describing a problem of a conventional technique.

As described above, in the automatic musical performance processing according to the second embodiment, when the start/stop flag STF is set at "1" in accordance with the user's start/stop switch operation, the CPU 13 replays, among the plurality of tracks Tr(1) to Tr(N) corresponding to the musical performance parts (musical instrument parts), the sequence data SD of tracks Tr(1) to Tr(N) other than a target track Tr(n) from the head of the musical piece in synchronization with the musical performance time TCT, as shown in FIG. 9.

Here, when the user performs an ON operation on a track ON/OFF switch (n) associated with the target track Tr(n) within the threshold TH from the head of the second measure as in the example shown in FIG. 9, the CPU 13 fast-forwards the sequence data SD of the target track Tr(n) set in a mute-ON state (muted state) from the head of the musical piece to the head of a measure currently being replayed in another track Tr(DN), and then sets the sequence data SD to a mute-OFF state (sound emission state).

Then, the CPU 13 sets the musical performance time TCT at a target track musical performance time DCT(n), and replays the sequence data SD of the second measure of the target track Tr(n) to the next measure timing T1 in synchronization with the target track musical performance time DCT(n) subjected to rate addition by use of a playback rate Ra calculated based on the above-described equation (2).

That is, from the timing of the ON operation on the track ON/OFF switch (n) to the next measure timing T1, the CPU 13 replays the sequence data SD (corresponding to notes e(n) to h(n) in the second measure) of the target track Tr(n) by fast-forwarding in accordance with the playback rate Ra.

Then, when the target track musical performance time DCT(n) reaches the next measure timing T1, the CPU 13 replays the target track Tr(n) at the same playback rate as that of the other tracks Tr(1) to Tr(N) which are being replayed in synchronization with the musical performance time TCT. As a result of this configuration, even by a novice user's track ON/OFF operation, an attack sound, which is musically important, can be emitted as intended.

On the other hand, when the user performs an ON operation on the track ON/OFF switch (n) associated with the target track Tr(n) at timing after the threshold TN, the CPU 13 fast-forwards the sequence data SD of the target track Tr(n) set in a mute-ON state (muted state) from the head of the musical piece to the current playback position of another track Tr(DN), sets the sequence data SD to a mute-OFF state (sound emission state) and then replays the sequence data SD of the target track Tr(n) in accordance with the target track musical performance time DCT(n) in synchronization with the musical performance time TCT.

That is, when an ON operation is performed on the track ON/OFF switch (n) at timing not close to the head of a measure, the CPU 13 fast-forwards the sequence data SD of the target track Tr(n) set in a mute-ON state from the head of the musical piece to the current playback position of another track Tr(DN), sets the sequence data SD to a mute-OFF state, and replays the sequence data SD of the target track Tr(n) in accordance with the target track musical performance time DCT(n) in synchronization with the musical performance time TCT.

As described above, in the first embodiment, sequence data representing each note of a musical piece for musical performance is provided for each track. When, for example, the sequence data of the second segment of at least one track (first music data) among these tracks is being replayed, if a target track (second music data) to be replayed is specified from among tracks not being replayed, the sequence data of the first segment of the target track is replayed at a speed higher than a normal speed, and then the second segment of the target track and the third segment of the other track are replayed at the normal speed in synchronization with each other, as shown in FIG. 5. Thereafter, the target track and the other track are replayed while being shifted from each other by one segment. For example, when the user presses a white key for a drum part, the first pattern phrase (first music data) of the drum part is replayed. When the first pattern phrase (first music data) of the drum part is being replayed, if the user presses a white key for a bass guitar part, a certain segment having the second pattern phrase (second music data) of the bass guitar part is replayed at a speed higher than a normal speed, and then the next segment is replayed at the normal speed. As a result of this configuration, even when the track-ON timing of a target track by the user is slightly shifted from the start timing of the second segment of another track being replayed, an attack sound, which is a head note sound in the first segment of the target track, is emitted. That is, it is possible to avoid drawbacks that musical performance effects are impaired due to no sound emission of the attack sound in the first segment of the target track Also, although the first segment of the target track is replayed at a speed higher than a normal speed and the playback of the target track and the playback of the other track are shifted from each other by one segment, playback can be enjoyed in which the playback of a certain segment of the target track and the playback of a certain segment of the other track have been synchronized with each other. In the first embodiment, tracks are shifted by the length of one segment corresponding to one measure. However, this one segment length is not limited to one measure, and may be a segment length longer than one measure such as two measures, or a segment length shorter than one measure.

Also, in the second embodiment sequence data representing each note of a musical piece for musical performance is provided for each track. When the sequence data of the second segment of at least one track (first music data) among these tracks is being replayed, if a target track (second music data) to be replayed is specified from among tracks not being replayed, the sequence data of the second segment of the target track is replayed at a speed higher than a normal speed in accordance with a calculated playback rate, and then the third segment of the target track and the third segment of the other track are replayed at the normal speed in synchronization with each other, as shown in FIG. 9. Thereafter, a certain segment of the target track and its corresponding segment in the other track are replayed in synchronization with each other. In the second embodiment, unlike the first embodiment, a target track and another track are not replayed with them being shifted from each other by a certain segment. As a result of this configuration, even when the track-ON timing of a target track by the user is slightly shifted from the start timing of a segment of another track being replayed, an attack sound, which is a head note sound in that segment of the target track, is emitted. That is, it is possible to avoid drawbacks that musical performance effects are impaired due to no sound emission of the attack sound in the segment of the target track. Also, after this segment of the target track is replayed at a speed higher than a normal speed, a synchronous playback can be enjoyed in which the playback of a segment of the target track and the playback of that segment of the other track are replayed in synchronization.

In the second embodiment, the sequence data (second music data) of a target track is fast-forwarded to a playback position corresponding to the timing of a specifying operation for the target track, and its playback is started from this position. As a result of this configuration, a playback segment of a target track and a playback segment of another track can be coincided with each other.

While the present invention has been described with reference to the preferred embodiments, it is intended that the invention be not limited by any of the details of the description therein but includes all the embodiments which fall within the scope of the appended claims.

What is claimed is:

1. A musical performance device comprising:

an operator; and a processor, wherein the processor performs (i) first playback processing for playing back first music data at a first playback speed, and (ii) second playback processing for performing a fast-forward playback of a certain segment among a plurality of segments in second music data specified when a certain segment in the first music data is being played back by the first playback processing at the first playback speed, in accordance with a playback rate acquired based on a timing at which the second music data is specified by operation of the operator, and performing a playback of a next segment following the certain segment in the second music data at the first playback speed, wherein the fast-forward playback of the certain segment in the second music data is performed at a second playback speed faster than the first playback speed of the next segment following the certain segment in the second music data, such that a timing at which a playback of a next segment following the certain segment in the first music data is started coincides with a timing at which the playback of the next segment following the certain segment in the second music data is started.

2. The musical performance device according to claim 1, wherein the second playback processing is performed such that, after the fast-forward playback of the certain segment of the second music data, segments following the certain segment of the second music data are automatically played back without being fast-forwarded.

3. The musical performance device according to claim 1, wherein the second playback processing is performed such that, after the fast-forward playback of the certain segment of the second music data, segments following the certain segment of the second music data are each automatically played back in synchronization with a segment of the first music data being played back by the first playback processing.

4. The musical performance device according to claim 1, wherein the certain segment of the second music data is a head segment of a musical piece, and a fast-forward playback of the head segment of the second music data is performed in the second playback processing.

5. The musical performance device according to claim 1, wherein the certain segment of the second music data is a current segment of the second music data corresponding to a current segment of the first music data being played back, and a fast-forward playback of the current segment of the second music data is performed in the second playback processing.

6. The musical performance device according to claim 1, wherein the playback rate is calculated from the timing at which the second music data is specified by the operation of the operator, and a timing at which a playback of a next segment following a current segment of the first music data being played back is started, and the fast-forward playback of the certain segment of the second music data is performed in the second playback processing such that the timing at which the playback of the next segment following the current segment of the first music data is started coincides with timing at which a playback of a next segment following the certain segment of the second music data is started.

7. The musical performance device according to claim 1, wherein the certain segment is a segment corresponding to a certain measure, and the playback in the second playback processing is performed such that playback speeds of a plurality of beats in the certain measure are equally high.

8. The musical performance device according to claim 1, wherein the certain segment is a segment corresponding to at least one beat.

9. The musical performance device according to claim 1, wherein the certain segment is a segment corresponding to at least one measure.

10. The musical performance device according to claim 1, wherein the first music data is a single piece of data or plural pieces of data.

11. The musical performance device according to claim 1, wherein the second music data is a single piece of data or plural pieces of data.

12. The musical performance device according to claim 1, wherein the first music data and the second music data are repeatedly played back when a playback has been specified.

13. The musical performance device according to claim 1, wherein the processor performs the first playback processing and the second playback processing simultaneously, such that the certain segment of the first music data is played back at the first playback speed while the certain segment of the second music data is played back at the second playback speed.

14. A musical performance method for a musical performance device, the method comprising:

playing back first music data at a first playback speed; and performing a fast-forward playback of a certain segment among a plurality of segments in second music data specified when a certain segment in the first music data is being played back at the first playback speed, in accordance with a playback rate acquired based on a timing at which the second music data is specified by operation of an operator, and performing a playback of a next segment following the certain segment in the second music data at the first playback speed, wherein the fast-forward playback of the certain segment in the second music data is performed at a second playback speed faster than the first playback speed of the next segment following the certain segment in the second music data, such that a timing at which a playback of a next segment following the certain segment in the first music data is started coincides with a timing at which the playback of the next segment following the certain segment in the second music data is started.

15. A non-transitory computer-readable storage medium having stored thereon a program that is executable by a computer in a musical performance device to actualize functions comprising:

playing back first music data at a first playback speed; and performing a fast-forward playback of a certain segment among a plurality of segments in second music data specified when a certain segment in the first music data is being played back at the first playback speed, in accordance with a playback rate acquired based on a timing at which the second music data is specified by operation of an operator, and performing a playback of a next segment following the certain segment in the second music data at the first playback speed, wherein the fast-forward playback of the certain segment in the second music data is performed at a second playback speed faster than the first playback speed of the next segment following the certain segment in the second music data, such that a timing at which a playback of a next segment following the certain segment in the first music data is started coincides with a timing at which the playback of the next segment following the certain segment in the second music data is started.

16. An electronic musical instrument comprising:

a keyboard having a plurality of keys, and a processor, wherein the processor performs (i) first playback processing for playing back, at a first playback speed, first music data specified by one of the plurality of keys being pressed, and (ii) second playback processing for performing a fast-forward playback of a certain segment among a plurality of segments in second music data specified by one of the plurality of keys being pressed when a certain segment in the first music data is being played back by the first playback processing at the first playback speed, in accordance with a playback rate acquired based on a timing at which the second music data is specified by said one of the plurality of keys being pressed, and performing a playback of a next segment following the certain segment in the second music data at the first playback speed, wherein the fast-forward playback of the certain segment in the second music data is performed at a second playback speed faster than the first playback speed of the next segment following the certain segment in the second music data, such that a timing at which a playback of a next segment following the certain segment in the first music data is started coincides with a timing at which the playback of the next segment following the certain segment in the second music data is started.

* * * * *